US005445075A

United States Patent [19]

Panipinto

[11] Patent Number: 5,445,075

[45] Date of Patent: Aug. 29, 1995

[54] DOUBLY ARTICULATED SCREEN PRINTING APPARATUS WITH ON-LINE REGISTRATION CAPABILITY

[76] Inventor: Charles L. Panipinto, 1901 Rock St. #414, Mountain View, Calif. 94043

[21] Appl. No.: 176,424

[22] Filed: Jan. 3, 1994

[51] Int. Cl.[6] ..... B41F 15/36

[52] U.S. Cl. ..... 101/127.1; 101/115; 101/DIG. 36

[58] Field of Search ..... 101/115, 126, 127.1, 101/128, 128.1, DIG. 36

[56] References Cited

U.S. PATENT DOCUMENTS

| | | | |
|---|---|---|---|
| 2,796,831 | 6/1957 | Heestand | 101/127.1 |
| 4,722,272 | 2/1988 | Caruccio et al. | 101/126 |
| 4,846,058 | 7/1989 | Farris | 101/126 |
| 5,018,441 | 5/1991 | Miraglia, Jr. | 101/128 |
| 5,161,460 | 11/1992 | Andersen et al. | 101/127.1 |

*Primary Examiner*—Edgar S. Burr
*Assistant Examiner*—Stephen R. Funk
*Attorney, Agent, or Firm*—William L. Chapin

[57] ABSTRACT

A screen printing apparatus includes a plurality of novel printing mechanisms, one each at the outer end of a radially disposed support arm having a first, elbow joint and attached at the inner end of the arm to a vertically disposed, rotatable hub. Each printing mechanism includes a screen frame clamp pivotably mounted at a second, vertically pivotable wrist joint to a base section, allowing pivotability of a screen held in the clamp. The base section has attached at an outer end thereof an alignment bar having a plurality of upwardly protruding registration pins. A transparent calibration plate has holes therethrough adapted to insertably receive the registration pins, in an overlying relationship to an object to be printed on a platen beneath the calibration plate. A yoke plate attachable at an adjustable height and radial distance to the support arm supports the base section at a releasably clampable position adjustable in a horizontal plane relative to an object to be printed, thereby allowing a proof image to be printed on the calibration plate, the screen pivoted upwards on its wrist joint, and the base section, alignment bar and attached calibration plate moved in any direction in a horizontal plane required to bring the proof image into precise registration with a reference point or image on the object to be printed, clamped in that position, and the calibration plate removed, whereupon a precisely aligned image may be printed on an object on the platen.

16 Claims, 11 Drawing Sheets

DOUBLY ARTICULATED SCREEN PRINTING APPARATUS WITH ON-LINE REGISTRATION CAPABILITY

BACKGROUND OF THE INVENTION

1. Field of the Invention

This invention relates to methods and apparatus for screen printing. More particularly, the invention relates to a multistation screen printing apparatus having an on-line registration capability that enables printing multiple, precisely registered different color images on a plurality of substrates, such as T-shirts, without requiring trial and error printing of proof images on test stock.

2. Description of Background Art

Screen printing is a widely used method of printing multicolored images onto signs, T-shirts and the like. The process involves first preparing a fine-mesh screen of silk, polyester, or metal by coating it with a photosensitive emulsion, contact printing with a bright light source a photographic image on the emulsion, which thereby hardens the emulsion, and washing away the unexposed emulsion. This preparation process leaves open mesh areas of the screen in the areas where ink is to be permitted to flow through to produce a desired image.

A screen bearing an image produced as described above is placed in intimate contact with the surface of the object to be printed. Ink is then poured over the screen and squeezed through the fine openings in the screen by drawing a squeegee across the surface of the screen, to print the desired image on the surface of the object.

It a single color image is to be printed, the printing process described above is a relatively straight forward operation. Thus, when a single color image is printed on an object, a slight misalignment between the object and the screen printing frame results in a printed image which is slightly misaligned with respect to the perimeter of the object. However, a slight misalignment of the printed image is often imperceptible to most people, and therefore is usually acceptable from an appearance standpoint.

When successive, different colored images are printed onto a surface of an object, the orientation of the object with respect to each screen printing frame used to print each successive color becomes much more critical than for single color printing. This is because improper registration between the various colored images making up a composite, multi-colored image results in an aesthetically unacceptable, blurred, smeared appearance.

To produce accurate registration of successive printed images on a given object, screen printers often use a pair of target markings on the screen. A typical target marking is a small circle having perpendicular cross hairs intersecting at the center of the circle. Targets are contained on each screen, and printed on the object with each color. Before each successive color is printed, targets on the screen are visually aligned with the previously printed targets on the object. Target alignment is done before ink is squeezed through the screen to produce the image. This is a time consuming process, and has the additional draw-back of requiring target markings on the printed objects.

A Printing Screen Registering Device employing the method of multiple image registration described above is disclosed in U.S. Pat. No. 2,796,831, issued to P. I. Heestand for a device of that title. The Heestand patent discloses a clamp apparatus for registering, via marks on the screen and sheet to be printed, a printing screen on a table or bed plate for repeatedly printing a pattern in exactly the same registered position on successive sheets of paper or the like.

A screen printing machine using a transparent sheet to check registration of a successive image with a previously printed image is disclosed in German Patent No. 2,816,573, issued Nov. 2, 1978 to Svecio Silkscreen. The machine disclosed includes an adjustable printing table by which an image on an attached sheet may be brought into registration with an image printed on a transparent sheet. Each time a new sheet to be printed is mounted to the printing table, the registration adjustment process must be repeated.

Other screen printing machines relating generally to the field of the present invention are disclosed in the following United States patents:

Harpold, 4,315,461, Feb. 16, 1982, Screen Printing Machine: Discloses a screen printing machine comprising a platen connected with a frame, and a printing head rotatably mounted on the frame and having at least two printing screens pivotally connected therewith for pivoting the same between a printing position, and a raised storage position. The printing head is slidably and removably connected with the frame for selectively locating a pattern on the article to be printed, and/or bodily removing the printing head for replacement with an alternate printing head assembly having a different pattern therein, without disturbing the registry between the mating designs in the printing screens.

Padula, 4,949,635, Aug. 21, 1990, Textile Printing Apparatus: Discloses a textile printing apparatus for multicolor printing that has a plurality of upper and lower arms radiating from a central hub and axle and which are rotatable with respect to one another. The lower arms have platforms for receiving textile workpieces, and the upper arms have clamping means for holding a stencil on top of a workpiece. The upper arms may be raised and lowered to facilitate sequential printing of colors onto a workpiece. Adjustment means are provided for the upper arms so that precise alignment of the stencils can be readily achieved when setting up the apparatus.

Barlow, 4,972,773, Nov. 27, 1990, Registration System For Silk Screen: Discloses a registration system to enable accurate registration of a silk screen in relation to a printing surface which enables adjustment of the silk screen in a simple and efficient manner. The registration system includes support clamps for the silk screen frame together with mounting means for the support clamps which can be easily adjusted by rotating a single, large and readily accessible knob with the mounting structure for the silk screen being counterbalanced by an eccentric weight with the features of the registration system cooperating to enable accurate registration of the silk screen during multiple color printing operations.

Andersen, et al., 4,974,508, Dec. 4, 1990, Screen Printing Apparatus: Discloses a multiple screen printing apparatus for multiple simultaneous printing in which the screen printing carrier head and the platen carrier head are indexed and locked together when the printing screens are down so as to provide precise registration. This indexing and locking arrangement resists degradation of the screen's registration during normal field use. Also, the apparatus has a precise microregistration adjustment system that permits adjustment of the printing screen attachment or screen clamping member relative to the screen carrier head by a controlled and guided adjustment movement in a single plane between a clamping plate and base member. This arrangement provides a coplanar locking so that no movement of the registration occurs during the clamping action.

Harpold, et al., 5,020,430, Jun. 4, 1991, Printer: Discloses a silk screen printing machine having a track about which the printing screens and platens are free to be moved relative to one another in the course of a multi-step printing process. An embodiment is disclosed having the printing screens supported by spokes and platens manually rotatable about a circular supporting track without supporting spokes. The platens move on a common horizontal plane below the printing screens which are brought down onto the platens for screen printing.

Taylor, 5,094,161, Mar. 10, 1992, Counter Top Multi-Color Single Station Printing Method and Apparatus: Discloses a multicolor printing apparatus specifically adapted for printing designs on clothing by the application of ink to successive silk screens, the apparatus including a pedestal having registration pins for insertion in openings in the silk screen supporting frame, and a clamping plate is hingedly mounted above the supporting frame with a lever arm to force the clamping plate downwardly against the support frame into complete registry with the pins. Lift tabs are also provided to lift the supporting frame away from pins after completion of each printing stage, and a printboard is adjustably mounted on a pivot arm to align the article of clothing with respect to the silk screen.

In U.S. Pat. No. 4,846,058, Farris, Multiple Registered Screen Printing Method and Apparatus With Removable Platens, a method and apparatus for screen printing a sequence of accurately registered images on a plurality of sheets or objects such as T-shirts is disclosed. The apparatus includes primary register platens supported by a platen support table. The primary register platen may be moved in a horizontal plane relative to the platen support table, and repositionably secured thereto. Each object to be printed is temporarily fastened to a separate secondary register platen, which may be quickly placed in a precisely repeatable overlying relationship to the primary register platen, and quickly removed therefrom. The apparatus includes a transparent register plate which may be quickly placed in an overlaying relationship to an object on a secondary register platen, in a precisely repeatable position relative to said platen support table, and quickly removed therefrom. A screen frame pivotable in a vertical plane and fastened to the platen support table is pivoted down into overlying contact with the upper surface of the transparent register plate, and a test image printed on the surface. The screen frame is then tilted away, permitting repositioning and securing the primary register platen to align the image with a desired printing position on the surface of the object affixed to a secondary register platen attached to the primary support platen. The transparent register plate is then removed, permitting the surface of the object to be printed. Since each secondary platen bearing an object is removably installable on the apparatus in a precisely repeatable position, each object may be printed with a precisely registered image. Each different successive color image (typically a total of 4 to 6) requires a re-adjustment of the primary register platen with respect to the platen support table, after a test printing of the new color image on the transparent registration plate.

The present invention was conceived of to provide an improved, multi-station screen printing apparatus having an on-line registration capability that enables a plurality of objects to be printed with a sequence of precisely registered, different color images, and which does not require trial and error test printing on test stock to effect precise registration of the multiple images.

OBJECTS OF THE INVENTION

An object of the present invention is to provide an improved multi-platen, multi-screen screen printing apparatus for printing a sequence of accurately registered different colored images on a T-shirt or other substrate to be printed, without the requirement for printing a sequence of images on test stock in trial and error procedures required by prior art machines.

Another object of the invention is to provide a multi-station screen printing apparatus having a plurality of platens for holding objects to be printed, the platens being attached to the outer ends of a plurality of radially disposed arms attached at the inner ends thereof to a rotatable hub, and a plurality of screen holders attached to the outer ends of radial arms located above the platen arms, the screen holder arms being attached at the inner ends thereof to a hub rotatable about the same axis as the platen arms hub, each screen arm having a first, radially inwardly located elbow joint vertically pivotable to allow the arm to be pivoted upwards to clear the platens, and a second, radially outwardly located wrist joint allowing a screen in a printing position contacting a platen to be pivoted upwards to permit alignment of the screen with the platen.

Another object of the invention is to provide a screen printing apparatus having a printing head adjustably fastened to the end of a radial screen printing arm, the arm being movable in any direction in a horizontal plane with respect to the arm.

Another object of the invention is to provide a screen printing apparatus having a printing head movable in any direction in a horizontal plane with respect to a radially inwardly disposed supporting arm, the printing head having an attached alignment bar adapted to removably secure a transparent calibration plate in a precisely repeatable overlying relationship to an object platen, and a screen frame clamp pivotably mounted to the head to permit pivotal motion in a vertical plane upwards to allow visual alignment of a proof image printed on the calibration plate with a reference point on the object to be printed on the platen, and pivotable downwards into a parallel overlying relationship with respect to the platen for printing an object on the platen.

Another object of the invention is to provide a screen printing apparatus having a radially mounted printing head including a base section movable to an adjustably securable location in any direction in a horizontal plane with respect to the end of the arm, the base section having an alignment bar provided with registration pins adapted to removably engage a transparent calibration plate at a precisely repeatable position with respect to the base section, and a screen frame clamp pivotably fastened to the base section, in a manner permitting pivotal motion in a vertical plane of the clamp and an attached screen printing frame and screen.

Another object of the invention is to provide a screen printing apparatus having a base section movable in any direction in a horizontal plane with respect to a supporting yoke, and securable to the yoke by means of an elongated threaded member protruding downward from the base section through the yoke and threadably engaged by a clamping disk located beneath the yoke.

Another object of the invention is to provide a screen printing apparatus having a base section movable in any direction in a horizontal plane with respect to a yoke, and securable to the yoke by means of a threaded bolt protruding downwards through the yoke and threadably engaged by a clamping disk beneath the yoke, the bolt head having a longitudinally disposed, eccentrically located upwardly protruding pin attached to the bolt head and engaged by a slot in a cam block movable transversely by a lead screw rotatable by a handle at an end thereof to loosen the clamping disk, thereby permitting adjustable movement of the base section with respect to the yoke, and rotatable in the opposite direction to tighten the clamping disk to maintain the base section fixed with respect to the yoke.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprises an improved screen printing apparatus adapted to print a plurality of different colored images on a plurality of substrates such as T-shirts, signs or other such objects.

The invention includes a novel printing mechanism having a printer head provided with a screen holder frame clamp attached to the outer end of a radially disposed arm which is pivotable at a first, vertically, radially inward located elbow joint to a downward, horizontal position placing a printing screen in contact with a T-shirt or other substrate to be printed lying on the upper surface of a platen, and pivotable upwards to a location above the platen. In the preferred embodiment, a plurality of the novel printing mechanisms, one each at the end of a separate radially disposed arm is provided. Each arm is attached at the inner radial end thereof to a first wheel having a hub rotatable about a vertically disposed axle, thereby permitting rotational movement in a horizontal plane of a sequence of separate printing mechanisms into position above a platen, each mechanism having a printing head holding a different screen for printing a different colored image on a substrate held on a single platen. Also in the preferred embodiment, the apparatus includes a plurality of platens, one each at the end of a separate radially disposed arm, each arm attach at the inner radial end thereof to a second wheel having a hub located below the screen arm hub and rotatable about the same vertically disposed axle, thus allowing a plurality of objects, one on each platen, to be rotated into place at a location, or printing station, attended by a single operator.

The novel screen printing mechanism according to the present invention includes a printing head support structure fastenable to the outer end of a radially disposed screen frame arm at an adjustable height and radial distance from the hub. The support structure includes a radially outwardly located yoke plate having through its thickness dimension a rectangular aperture.

The printer head includes a base section secured to the yoke plate by clamping means comprising in combination a circular clamping disk located beneath the yoke plate and having a diameter larger than the aperture through the yoke plate, and a bolt having a threaded shank protruding downwards from the base section and tightenable in a threaded central bore through the clamping plate to exert a compressive force sandwiching the yoke plate between the flat bottom of the base section and the clamping disk. Thus constructed, the base plate may be moved in any direction parallel to the plane of the yoke plate, i.e., radially, tangentially, and rotationally with respect to the yoke plate, with the bolt loosened.

The base section of the printer head includes a flat, generally rectangularly shaped base plate and a pair of opposed perpendicularly upwardly protruding side plates. A transversely disposed, C cross-section channel clamp adapted to clampably hold a screen frame is pivotally mounted between the side plates, allowing a screen held therein to be pivoted upwards at a second, wrist joint, from a downward, horizontally disposed printing position to a vertical inspection position.

The base section also includes an elongated, rectangular cross-section alignment bar attached to the front edge of the base plate. The alignment bar is provided with registration pins, preferably two or more, that protrude upwards from the upper surface of the alignment bar. These pins are adapted to be insertably received by a pair of aligned holes located near the rear edge of a thin, transparent, rectangularly-shaped calibration plate, which is positioned in a calibration step over a substrate to be printed and located on a platen. After a calibration image has been printed on a calibration plate, the channel clamp, screen frame and attached screen may be pivoted upwards away from the calibration plate and substrate. The base clamping plate may then be loosened, allowing the base section and attached calibration plate to be moved in any direction in a horizontal plane that are required to place the image printed on the calibration plate in a desired precisely aligned position overlying a previously printed image or reference point on the substrate, whereupon the clamp may be tightened. The calibration plate is then removed.

In an exactly analogous fashion, a plurality of the novel screen printing heads, one for each color image to be printed, is calibrated according to the procedure described above. After completion of the calibration procedure, a plurality of substrates, one each on a separate platen, may be printed with a plurality of precisely registered, different colored images, without any test printings or further calibration procedures.

DETAILED DESCRIPTION OF THE PREFERRED EMBODIMENTS

Referring now to FIGS. 1 through 11, a novel doubly articulated screen printing apparatus with on-line registration capability according to the present invention is shown.

Figure 1:
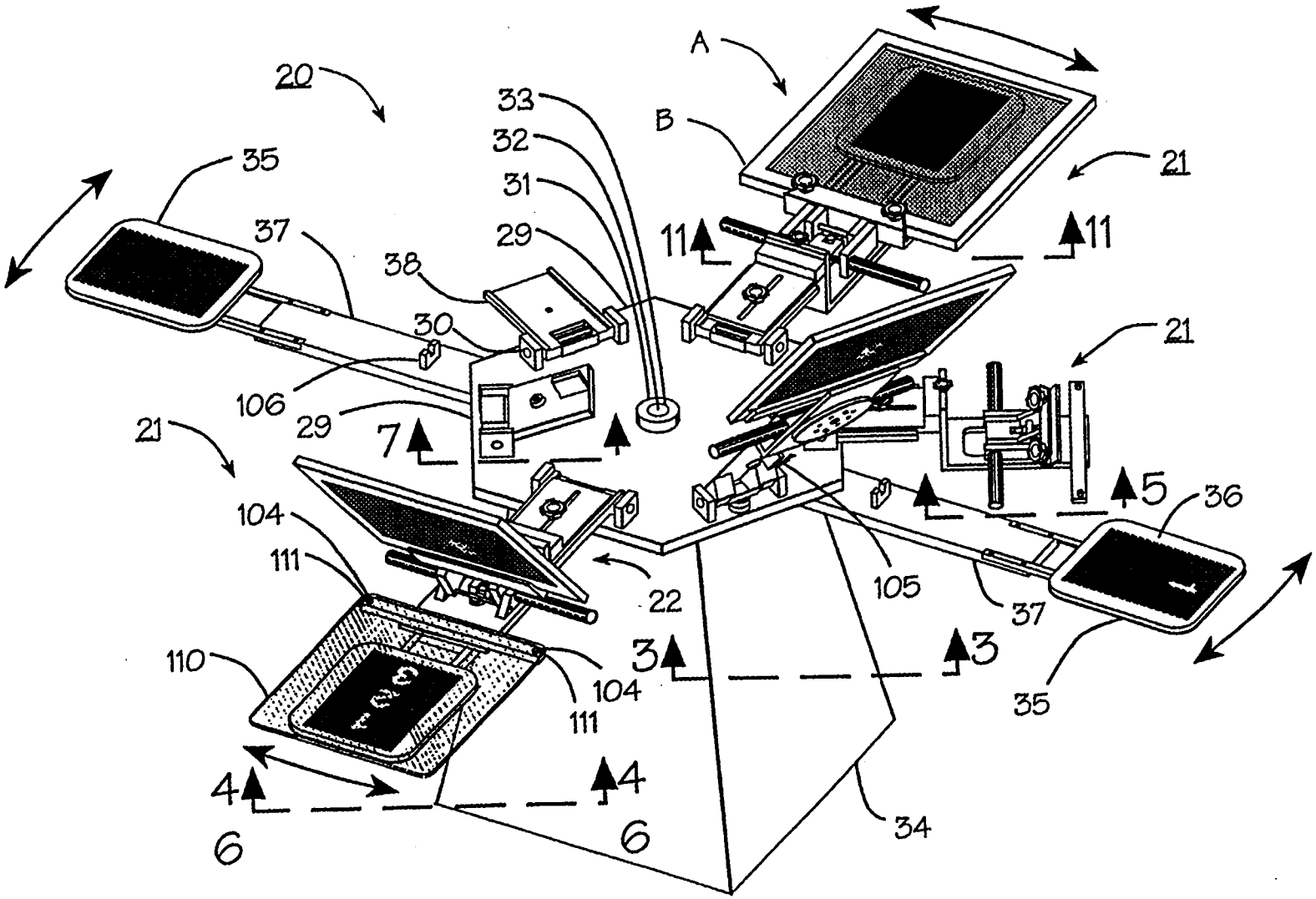
FIG. 1 is a perspective view of a doubly articulated screen printing apparatus according to the present invention.
Figure 2:
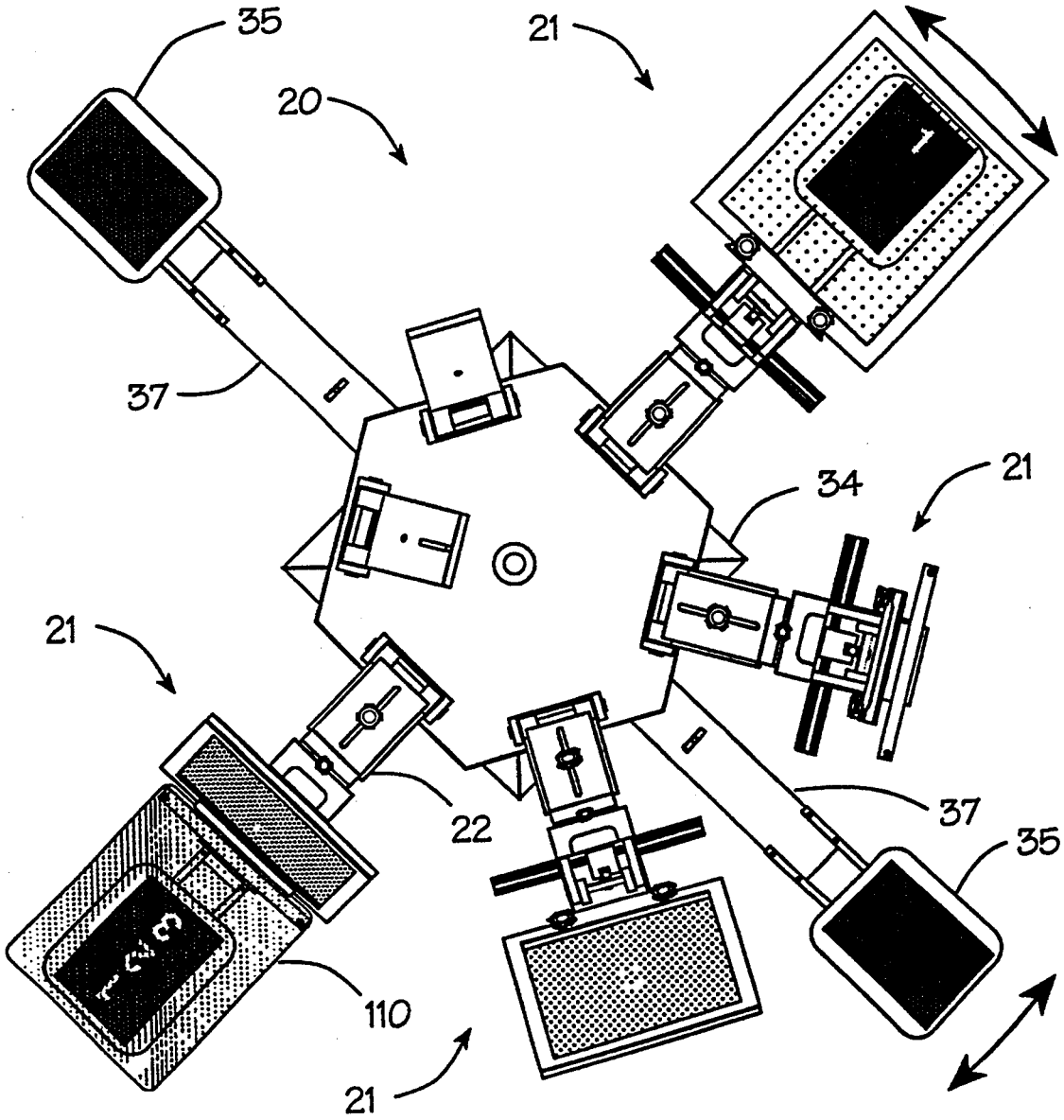
FIG. 2 is an upper plan view of the apparatus of FIG. 1.
Figure 3:
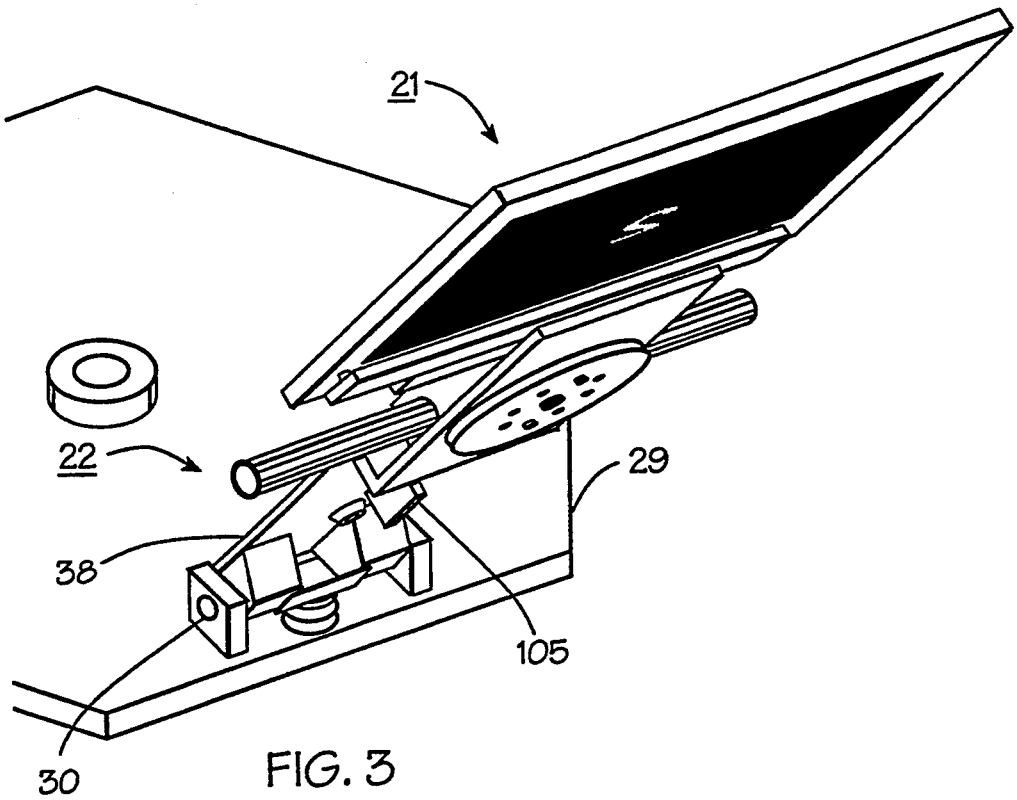
FIG. 3 is a fragmentary left side perspective view of part of the apparatus of FIG. 1, showing one screen holder arm thereof on a somewhat enlarged scale, and showing the screen holder arm pivoted upwards at an elbow joint thereof.
Figure 4:
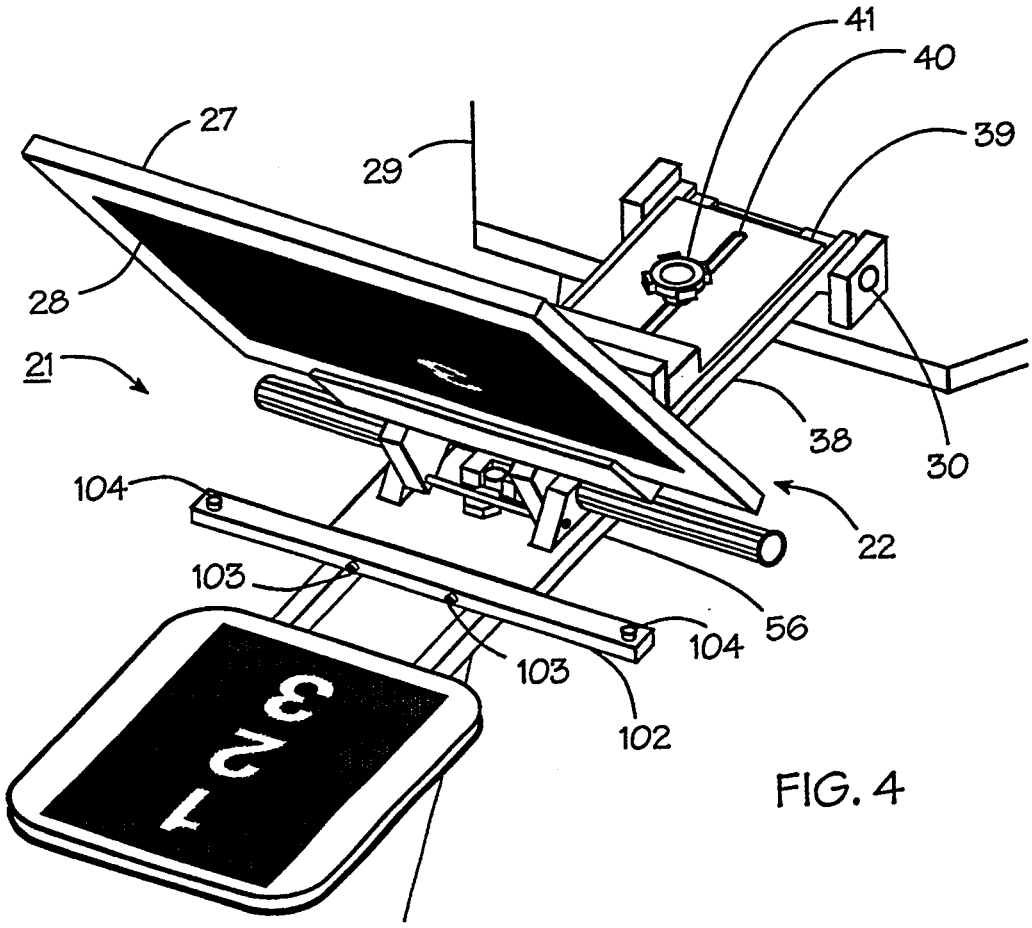
FIG. 4 is a right side perspective view similar to that of FIG. 3, but showing the screen holder arm thereof pivoted upwards at a wrist joint.
Figure 10:
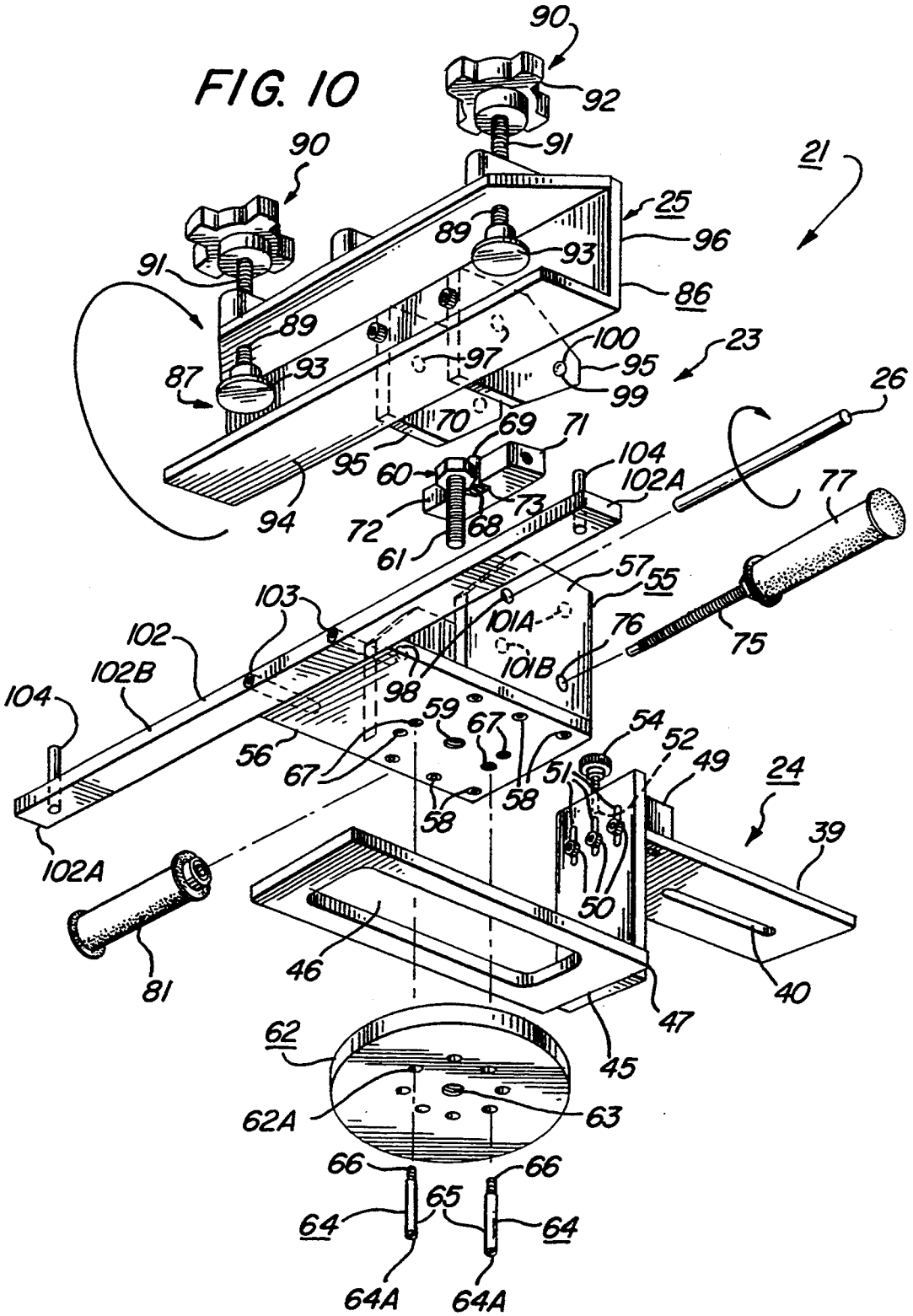
FIG. 10 is an exploded bottom view of a printing head forming part of the apparatus of FIG. 9.

As may be seen best by referring to FIGS. 1 and 2, the novel doubly articulated screen printing apparatus 20 according to the present invention includes at least one screen printing mechanism 21 that is attached to the outer portion of a radially disposed arm 22. As shown in FIGS. 4 and 10, printing mechanism 21 includes a printer head 23 that is adjustably fastened to a support structure 24 in a manner to be described in detail below. Printer head 23 has an elongated, C cross-section screen frame channel clamp 25 pivotably mounted to printer head 23 by means of a wrist pivot pin 26 that allows pivotability in a vertical plane of a screen frame 27 and screen 28. As shown in FIGS. 1 and 3, the inner radial end portion of printing mechanism support arm 22 is pivotably attached to a support table 29 by means of an elbow pivot pin 30 that allows pivotability in a vertical plane of the support arm. As will become apparent from the detailed description to be given later, the second, wrist pivot 26 cooperates with other elements of the novel screen printing mechanism 21 to provide important advantages over prior art screen printing apparatuses of the type that employ a single, elbow joint similar to elbow joint pin 30 shown in FIGS. 1 and 3.

The preferred embodiment of screen printing apparatus 20 shown in FIG. 1 includes a plurality of novel printing mechanisms 21, each attached to the outer radial end of a separate radially disposed printing mechanism support arm 22. As shown in FIG. 1, the inner radial portions of printing mechanism support arms 22 are pivotably attached to a support table 29 at circumferentially spaced apart locations. Support table 29 has the shape of a horizontally disposed, wheel-like plate that includes a hub 31 supported on a vertically disposed axle 32 by a bearing 33. Axle 32 is supported in a vertically disposed position by a table support structure 34, thus allowing support table 29 and screen printing mechanism 21 attached to the support table to be rotated in a horizontal plane.

As shown in FIGS. 1 and 2, doubly articulated screen printing apparatus 20 also preferably includes a plurality of circumferentially spaced apart platens 35, each having a flat, horizontally disposed upper surface 36 adapted to hold a T-shirt, card stock or other substrate to be printed on. Each platen 35 is attached to the outer radial portion of a radially disposed arm 37.

As shown in FIGS. 1 and 2, platen support arms 37 radiate from axle 32, and are located below support table 29 and screen printing mechanism support arms 22. Preferably, the inner radial ends of platen support arms 37 are attached to axle 32 by a hub 31A and bearing assembly 33A that permits the platen support arms to rotate en masse in a horizontal plane.

Figure 7:
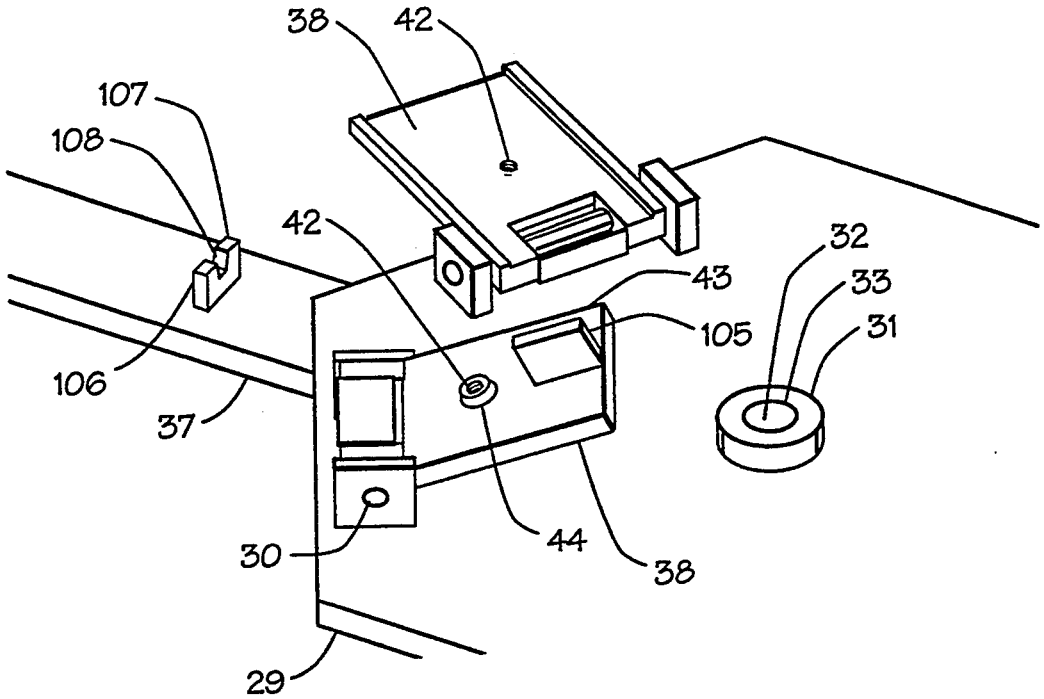
FIG. 7 is a fragmentary upper perspective view of part of the apparatus of FIG. 1.

As shown in FIGS. 4, 7, 10 and 11, radially disposed support arm 22 for each screen printing mechanism 21 includes a flat, plate-like rear forearm portion 38 pivotably fastened by elbow joint pin 30 to support table 29. As may be seen best by referring to FIG. 10, support arm 22 also includes a flat, plate-like front forearm portion 39 that has a narrow longitudinally disposed, elongated rectangular perforation 40 through its thickness dimension. Front forearm portion 39 is attached at an adjustable radial distance to rear forearm portion 38 by means of a thumb screw 41 having a threaded shank (not shown) that is inserted downward through slotted perforation 40 through front forearm 39, and tightened into a threaded bore 42 provided through the thickness dimension of rear forearm 38. Preferably, as shown in FIG. 7, the lower surface 43 of rear forearm 38 has formed therein a strengthening boss 44 having a threaded central coaxial bore continuous with threaded bore 42. The novel construction of screen printing mechanism 21 of the present invention may be best understood by referring to FIGS. 8 through 10.

Figure 5:
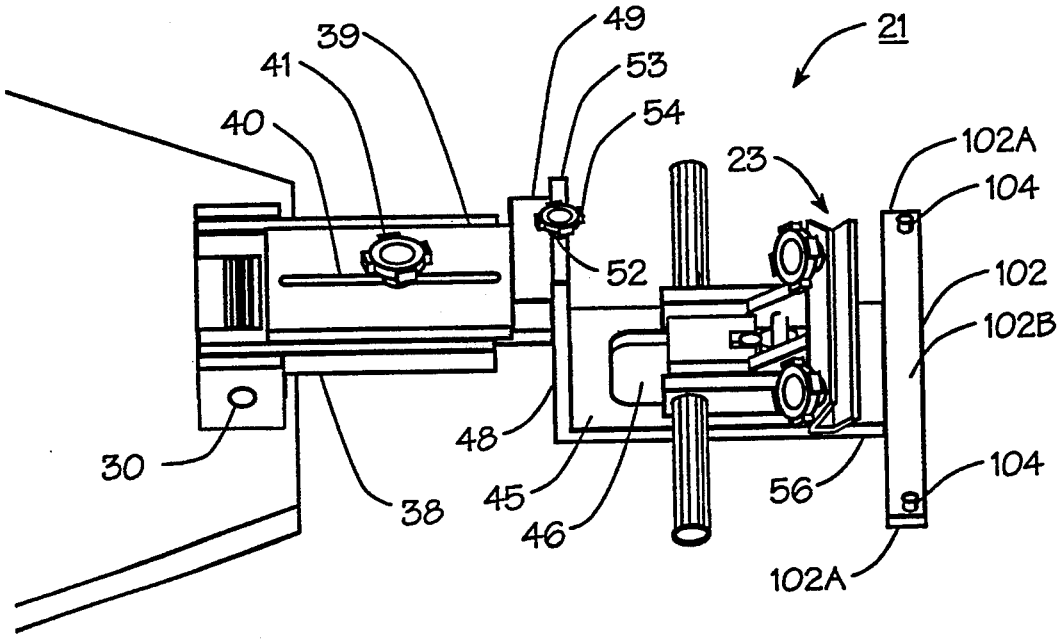
FIG. 5 is an enlarged side perspective view of the apparatus of FIG. 4, showing a screen frame and screen removed from a screen channel clamp located at the end of the arm, and showing details of a horizontal alignment bar for positioning a transparent registration plate relative to a platen.

As shown in FIG. 10, printing mechanism 21 includes a printer head designated generally by the numeral 23, and a support structure designated generally by the numeral 24 and including front forearm 39. As may be seen best by referring to FIGS. 5 and 10, support structure 24 includes a longitudinally elongated, generally rectangularly shaped yoke plate 45 having through its thickness dimension a concentric rectangular perforation 46. Yoke plate 45 has attached to the radially inward or rear transverse edge wall 47 thereof a perpendicularly upwardly protruding connector plate 48. Also, front forearm 39 has attached to the upper surface thereof a transversely disposed, rectangular cross-section block 49 having a front edge wall flush with the front transverse edge wall of the front forearm. Connector plate 48 and attached yoke plate 45 are attached at an adjustable height to front forearm 39 by means of screws 50 inserted through a plurality of parallel, longitudinally disposed, rectangularly shaped perforations 51 through the thickness dimension of connector plate 48, into threaded holes (not shown) in the front transverse face of block 49. As shown in FIGS. 5 and 10, a threaded bore 52 extends downwards from the upper transverse edge wall 53 of connector plate 48 into the central one of the three longitudinally disposed, laterally spaced apart parallel slots 51. A thumbscrew 54 has a threaded shank (not shown) threadingly engaged in bore 52, the lower end of the shank bearing against the shank of a screw 50 disposed in central slot 51. The function of thumbscrew 54 is to permit small adjustments of the height of a screen held in clamp 25, with screws 50 loosened, so that the screen is out of contact ("off contact") with a substrate when squeegie pressure is removed.

As shown in FIGS. 8 through 11, printer mechanism 21 has a printer head 23 that is secured to yoke plate 45 at a position adjustable in a horizontal plane, in a manner which will now be described.

As may be seen best by referring to FIG. 10, printer head 23 has a base section 55 that includes a flat, rectangularly shaped base plate 56. Base section 55 also includes a pair of flat, laterally spaced apart side plates 57 that protrude upwards from the upper surface of the base plate 56. As shown in FIG. 10, side plates 57 are fastened to base plate 56 by means of screws 58. Of course, base section 55 could also be fabricated as a weldment or casting having integral base and side plates. Base plate 56 has through its thickness dimension a centrally located threaded bore 59, that is adapted to receive the threaded shank of a specially constructed bolt 60 having a threaded shank 61. Support structure 24 includes a circular disk-shaped clamping plate 62 having through its thickness dimension a central coaxial threaded bore 63 adapted to threadingly receive shank 61 of bolt 60. Clamping plate 62 is held irrotational with respect to base plate 56 of base section 55 by a pair of anti-rotation pins 64. Pins 64 are slidably received through a selected pair of a plurality of smooth bores 62A provided through the thickness dimension of clamping plate 62. Each pin 64 has a long, smooth shank 65 and a shorter reduced diameter, threaded front longitudinal end portion 66 that is threadingly received by one bore of a selected pair of threaded bores 67 extending perpendicularly upwards into base plate 56. Each pin 64 is preferably provided with a transversely disposed slot 64A in its circular face for receiving a screwdriver bit.

As may be understood by referring to FIG. 10, with clamping plate 62 and base section 55 of printer head 23 free to move with respect to yoke plate 45, the printer head may be moved in any direction in a horizontal plane with respect to the yoke plate, i.e., forward and backwards (radially), sideways (tangentially) and rotationally.

Printer head 23 includes means for quickly and effectively loosening clamping plate 62 to permit adjustment of the horizontal position of printer head 23 relative to yoke plate 45, and quickly tightening the clamping plate to exert a large compressive force that sandwiches the yoke plate between the upper surface of the clamping plate and the lower surface of base plate 56 of the printer head. Thus, as shown in FIG. 10, printer head 23 includes a specially constructed bolt 60 having attached to or formed in one hexagonal bolt head face 68 a longitudinally disposed, eccentrically located circular cross-section cam pin 69 that protrudes upwardly beyond the upper face 70 of the bolt head. Eccentric cam pin 69 is driven to exert a large torque on bolt 60 in a manner which will now be described.

Figure 8:
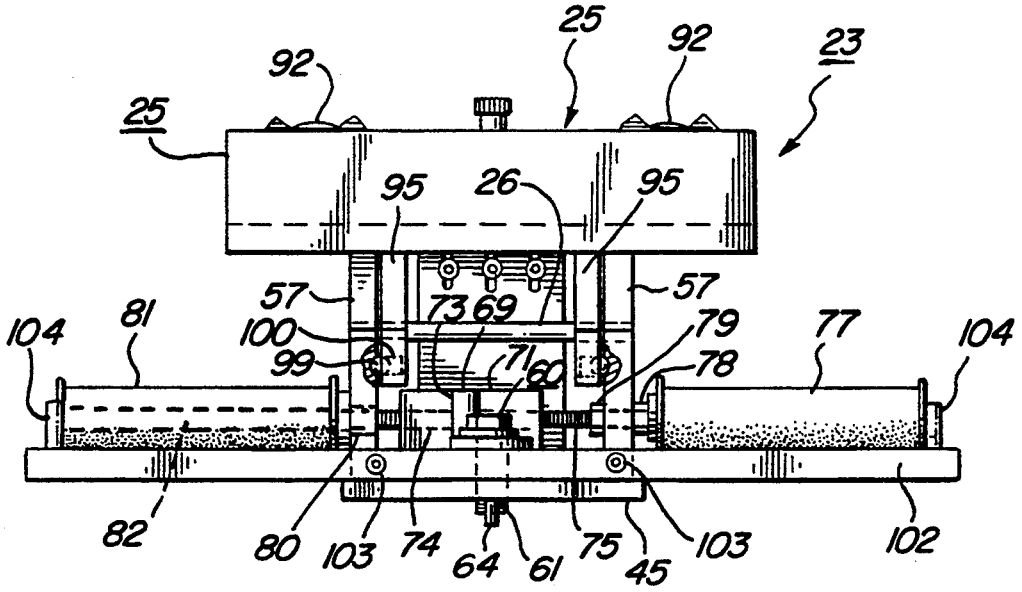
FIG. 8 is a fragmentary front perspective view of the article of FIG. 5, showing a lead screw fastened to a right handlegrip thereof turned to its maximum counter-clockwise position, to loosen the base clamp assembly at the end of the arm and allowing adjustable horizontal movement of a printing head relative to the arm.
Figure 9:
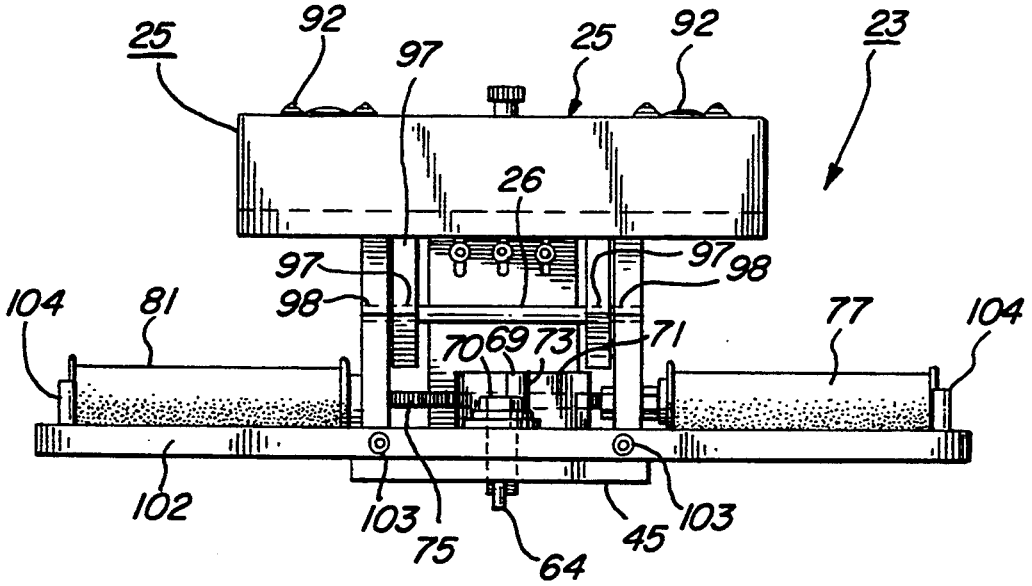
FIG. 9 is a view similar to FIG. 8, but showing the base clamp assembly tightened.

Referring now to FIGS. 8 through 10, bolt head cam pin 69 may be seen to be engaged by a vertically disposed slot 73 formed in the longitudinal front face 72 of a transversely disposed, rectangular-shaped cam block 71. Cam block 71 has through its length dimension a longitudinally disposed threaded bore 74, located rearward of front face 72 and slot 73 of the cam block. Bore 74 through cam block 71 threadingly receives a lead screw 75 that protrudes through a smooth bore through-hole 76 provided through right side plate 57 of base section 55. Lead screw 75 is attached at an outer end thereof to a coaxially located, cylindrically-shaped right handlegrip 77 by means of a nut 78. As shown in FIGS. 8 and 9, lead screw 75 is threadingly engaged by a nut 79 attached to the inner face of right side wall 57 and coaxially aligned with bore 76 through the side wall. The left or free end of lead screw 75 protrudes through a smooth bore 80 provided through left side wall 57 of base section 55, that bore being axially aligned with bore 76 through the right side wall. The outer end of lead screw 75 is received within a smooth clearance bore 82 which extends longitudinally inwards from the right circular face of a second, left handlegrip 81 that is attached to left side wall 57.

The cam block and lead screw construction described above permits rapid and easy loosening of clamping plate 62 to permit horizontal adjustment of printer head 23 relative to printing mechanism support arm 22, and rapid and easy tightening with sufficient clamping force to assure maintenance of the adjusted position. Thus, as shown in FIG. 8, with handlegrip 77 and attached lead screw 75 rotated to their counterclockwise limit, cam block 71 is advanced to its furthest longitudinal position relative to the right handlegrip. That motion of the cam block 71 causes bolt cam pin 69, which is pivotably held within slot 73 of the cam block, to move to its maximum counterclockwise position relative to the longitudinal axis of bolt 60, thus loosening threaded shank 61 of the bolt in threaded bore 63 of clamping plate 62. In this loosened position, printer head 23 may be moved in any position in a horizontal plane to achieve printing registration, as will be described later. After printer head 23 has been moved to a desired horizontal position, right handlegrip 77 and attached lead screw 75 are rotated clockwise about their common longitudinal axis, thus drawing cam block 71 towards the right handlegrip, as shown in FIG. 9. This movement of cam block 71 causes cam pin 69 to move clockwise with respect to the axis of bolt 60, causing a clockwise, tightening torque to be exerted on the bolt. Accordingly, clamping plate 62 is drawn upwards, exerting an upwardly directed compressive force that sandwiches yoke plate 45 between the clamping plate and base plate 56 of printer head 23, thus tightly clamping all three members securely together.

As may be seen best by referring to FIG. 10, printer head 23 of printing mechanism 21 includes a screen frame clamp 25 adapted to clampingly hold a silk screen frame. Screen frame clamp 25 includes a laterally elongated channel member 86 having a uniform C-shaped cross-section that has a front rectangular shaped opening 87 adapted to receive an elongated side member B of a screen frame A, as shown in FIG. 1. Clamp 25 has an upper flat plate section 88 provided through its thickness dimension with a pair of laterally spaced apart threaded bores 89. Bores 89 threadingly engage the threaded shanks 91 of a pair of clamping thumbscrews 90. Each clamping thumbscrew 90 has a handwheel 92 attached to the upper end of threaded shank 91, and a circular disk-shaped pressure pad 93 fastened, preferably by means of a ball and socket joint (not shown) to the lower end of the shank. Thus constructed, handwheels 92 of thumbscrews 90 may be turned clockwise to clamp a screen frame member inserted into opening 87 of clamp 85, between pressure pads 93 and lower flat plate section 94 of channel member 86.

Figure 6:
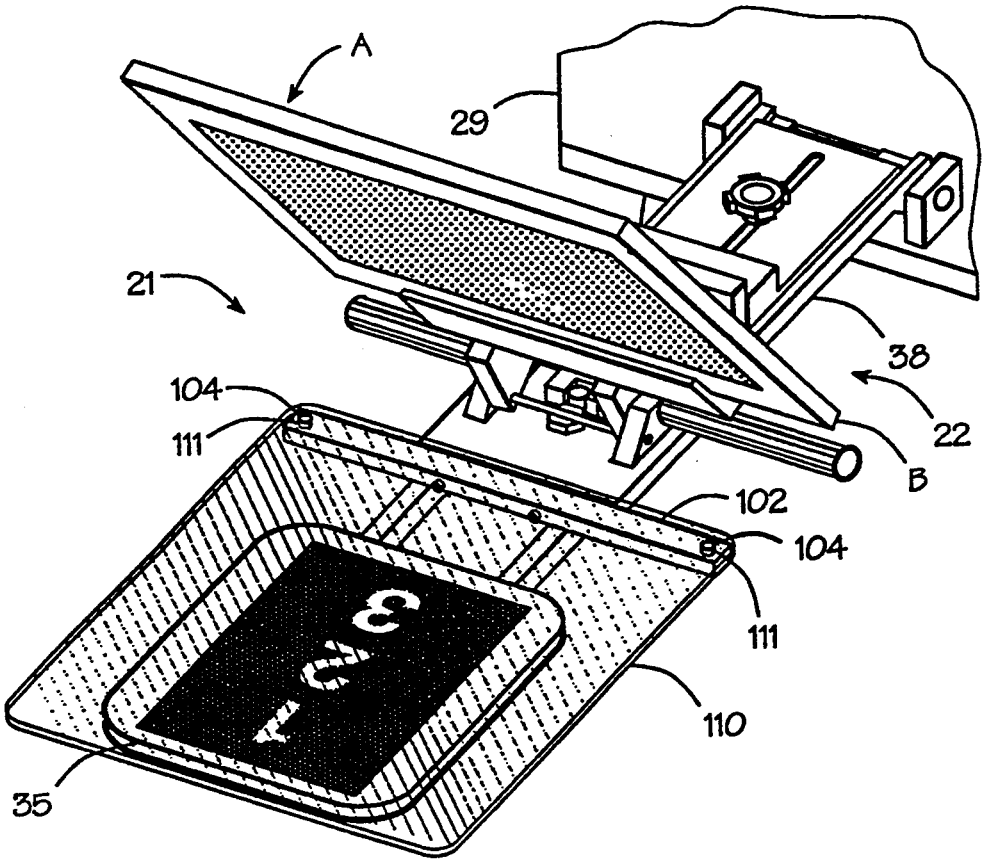
FIG. 6 is a view similar to FIG. 4, but showing a transparent registration plate placed on a platen, the registration plate being held in a fixed position relative to the platen by means of pins protruding upward from the alignment bar, positioned below the channel clamp, as shown in FIG. 5, the pins engaging registered holes through the transparent plate, near its rear edge.
Figure 11:
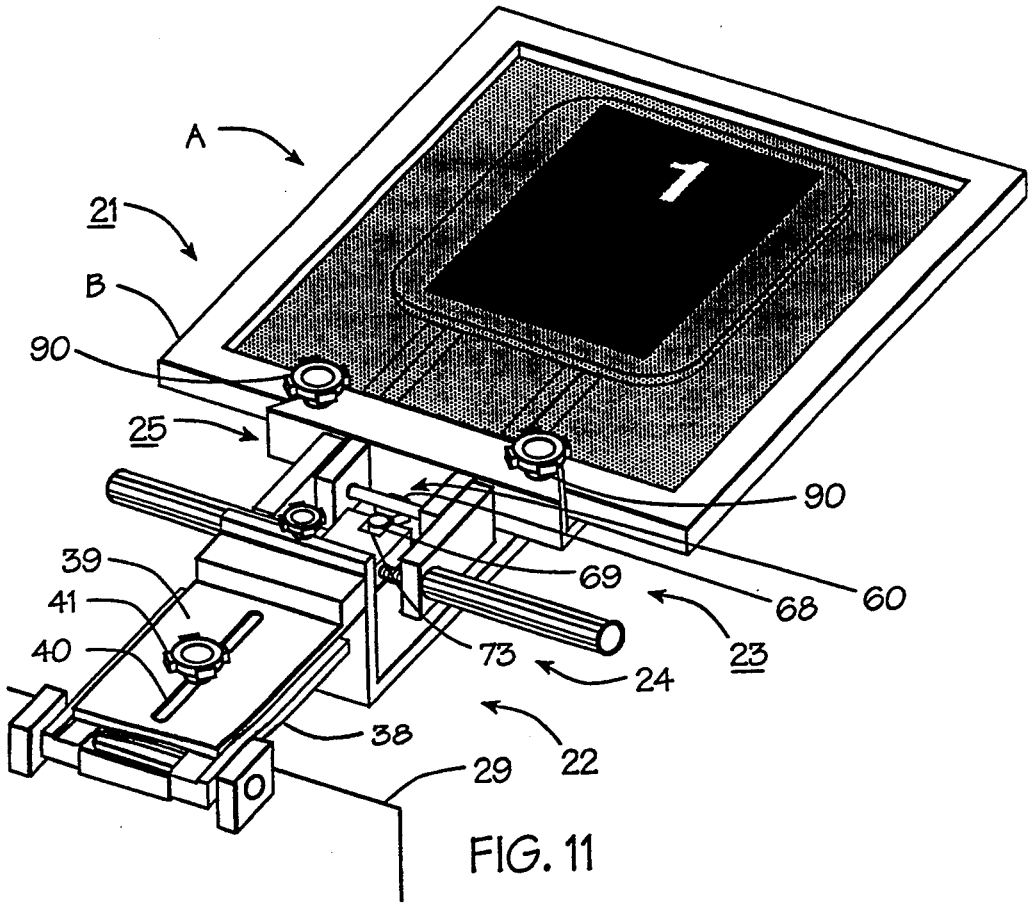
FIG. 11 is a fragmentary upper plan view of the structure of FIG. 10, showing the arm and screen holder clamp thereof tilted to a downward, printing position.

Screen frame clamp 25 is pivotably fastened to base section 55 of printer head 23, in a manner permitting vertical pivotable motion from a horizontal position, as shown in FIGS. 10 and 11, to intermediate positions, as shown in FIGS. 4 and 6, or to a fully upright position, as shown in FIGS. 8 and 9.

Referring now to FIG. 10, screen frame clamp 25 may be seen to have a pair of parallel, laterally spaced apart side plates 95 protruding perpendicularly rearward from a rear flat plate section 96 of channel member 86. Side plates 95 are preferably spaced equidistant from a transverse center plane of channel member 86. As shown in FIGS. 8 and 9, the lateral spacing between the outer wall surfaces of side plates 95 is slightly less than the lateral spacing between the inner wall surfaces of base section side walls 57, thus allowing the side plates to be insertably received between the side walls. Side plates 95 of screen frame clamp 85 have through their thickness dimensions a pair of laterally aligned clearance holes 97 that insertably receive a pivot pin 26. Pivot pin 26 is secured in a pair of holes 98, one each in each side wall 57 of base section 55, those holes being aligned with holes 97 through side plates 95.

In the preferred embodiment of printer head 23, detent means are provided to releasably lock pivotable screen frame clamp 25 in both the horizontal position, as shown in FIG. 10, and the upright most, vertical position, as shown in FIGS. 8 and 9. Thus, as shown in FIG. 10, each side plate 95 of screen clamp 25 has a detent ball 99 held within a generally hemispherically-shaped cavity 100 formed in the outer wall surface of the side plate. Each of the two detent balls 99 is preferably biased to a laterally outward position by resilient spring means, not shown. Also, the inner facing side wall of each side plate 57 of base section 55 has formed therein a pair of diagonally spaced apart upper and lower hemispherically-shaped depressions 101A and 101B, respectively, adapted to receive detent balls 99. Thus, with screen frame clamp 25 in a horizontal position, as shown in FIG. 10, detent balls 99 are releasably received in upper hemispherical depressions 101A of base section side plates 57. With the clamp in a vertical position, as shown in FIGS. 9 and 10, the detent balls are received in depressions 101B.

As may be seen best by referring to FIGS. 5 and 10, printer head 23 of printing mechanism 21 includes a laterally elongated rectangular cross-section, horizontally disposed alignment bar 102 attached to the front edge wall of base plate 56 of base section 55 of the printing mechanism, as for example by means of screws 103. Alignment bar 102 is preferably located symmetrically with respect to base section walls 57 of base section 55, the outer transverse end walls 102A of the alignment bar being equidistant from respective adjacent base section side walls. Also, upper wall 102B of alignment bar 102 is flush with the upper wall of base plate 56 of base section 55. Alignment bar 102 includes a pair of uniform cross-section registration pins 104 that protrude perpendicularly upwards from upper wall surface 102B of the alignment bar, each registration pin being spaced an equal distance laterally inwards from an adjacent side wall 102A of the alignment bar.

For reasons which will become apparent from the description of the operation of the printing apparatus according to the present invention, which is given below, the preferred embodiment of the invention preferably includes means for indexing a printing mechanism support arm with respect to a platen 35. Thus, as shown in FIGS. 3 and 7, rear forearm 38 of printer mechanism support arm 22 has formed in the lower surface of the forearm a perpendicularly downwardly protruding locating plate 105. Plate 105 preferably has a generally rectangular shape, and is adapted to be received in a trapezoidally-shaped notch 108 formed in the upper edge wall 107 of a modified U-block 106 that protrudes perpendicularly upward from the upper surface of each platen support arm 37.

OPERATION OF THE INVENTION

An appreciation of the advantages offered by screen printing operations using the novel apparatus described above may be enhanced by reviewing steps required for multi-colored, or multi-image screen printing using prior art screen printing methods and apparatus. Thus, as shown in the flow chart of FIG. 12, registration targets must be placed on each film positive for each different color image to be printed. The steps shown in FIG. 12 must be repeated for each different color to be printed. Typically, three different colors plus black are required for "four-color" process printing.

Figure 12:
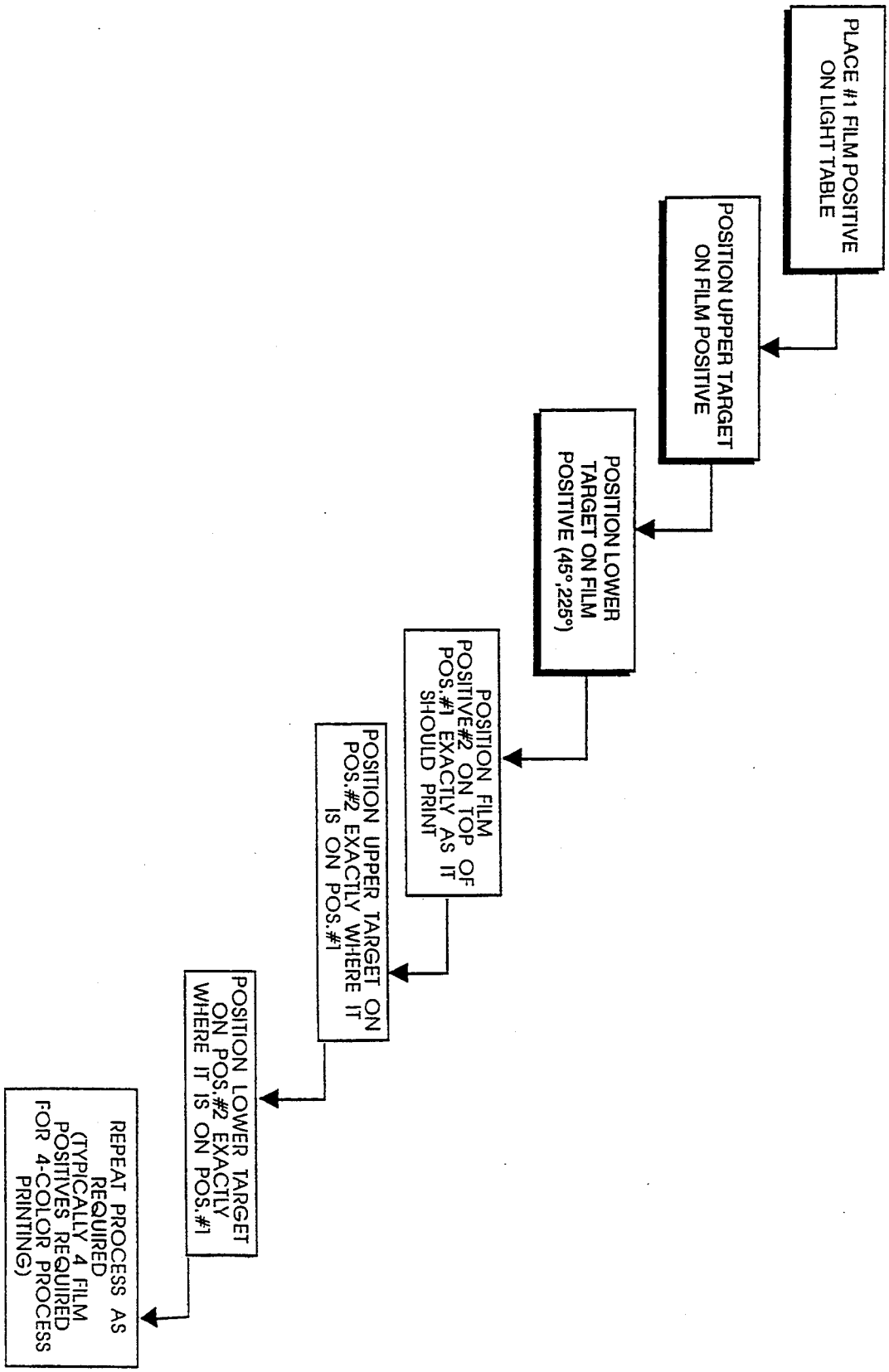
FIG. 12 (PRIOR ART)
FIG. 12 is a flow chart showing art department steps required preparatory to performing multi-image screen printing, using prior art apparatus.
Figure 13:
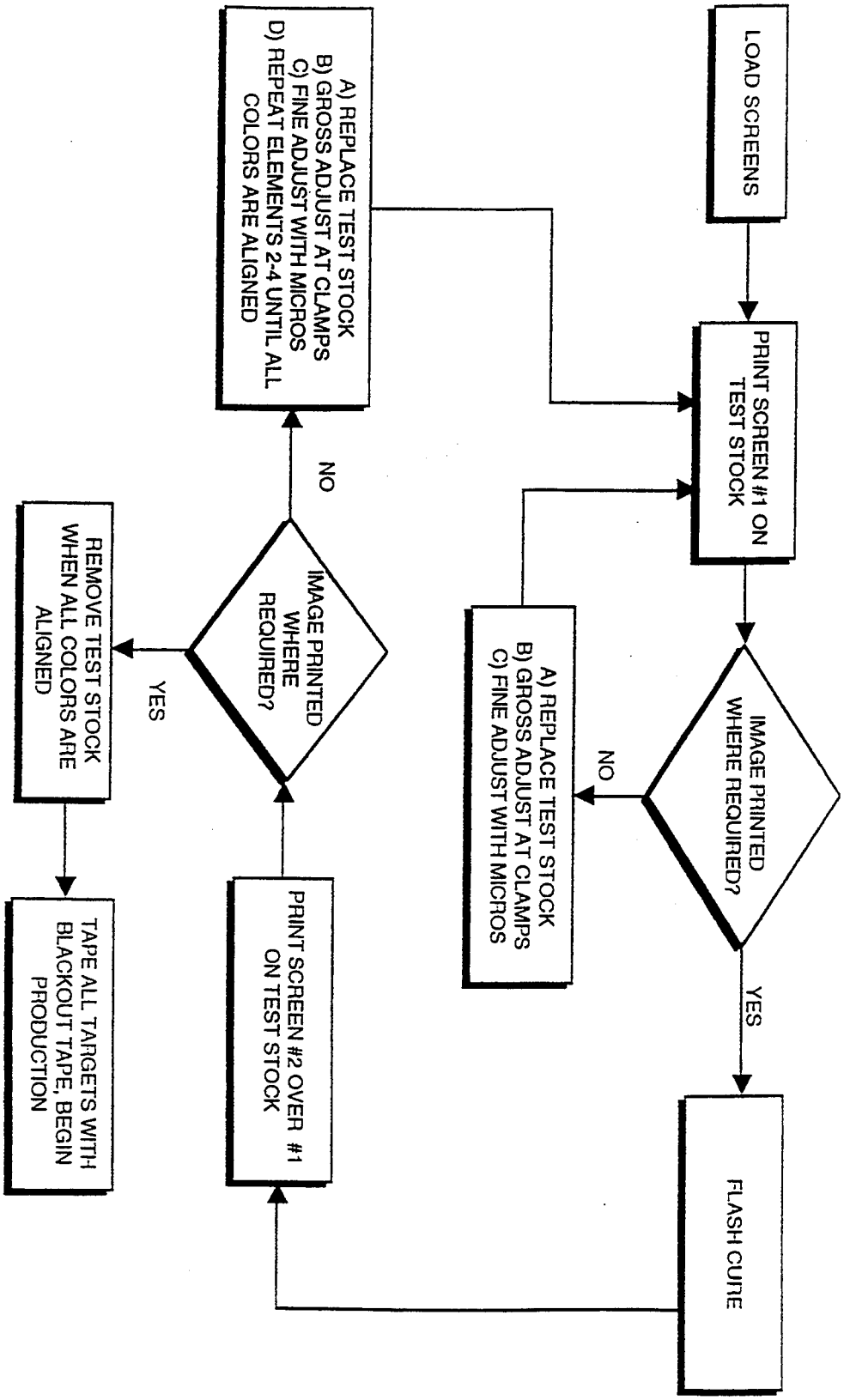
FIG. 13 (PRIOR ART)
FIG. 13 is a flow chart showing printing department steps required to accurately register multiple images, using prior art screen printing apparatus.

After each film positive is provided with a target, as depicted in FIG. 12, each film positive bearing a target is used to burn a separate silk screen. A screen bearing the first color image in a sequence of different color images, typically four, is then loaded into a screen printing apparatus similar to the novel apparatus according to the present invention depicted in FIG. 1, but lacking the novel printing head mechanism with the second, elbow joint, alignment bar, and yoke mounting. With prior art screen printing apparatus and methods, multiple trial and error steps must be performed to bring each image into proper registration with the substrates to be printed, as well as with each other. The steps indicated in the first two horizontal flow paths shown in FIG. 13 are required just to position a first color image in a sequence in proper registration within the perimeter of a T-shirt or other substrate to be printed. It should be noted that the loop shown in the first two rows may have to be repeated several times, since prior art registration procedures utilize a trial and error procedure.

Figure 14:
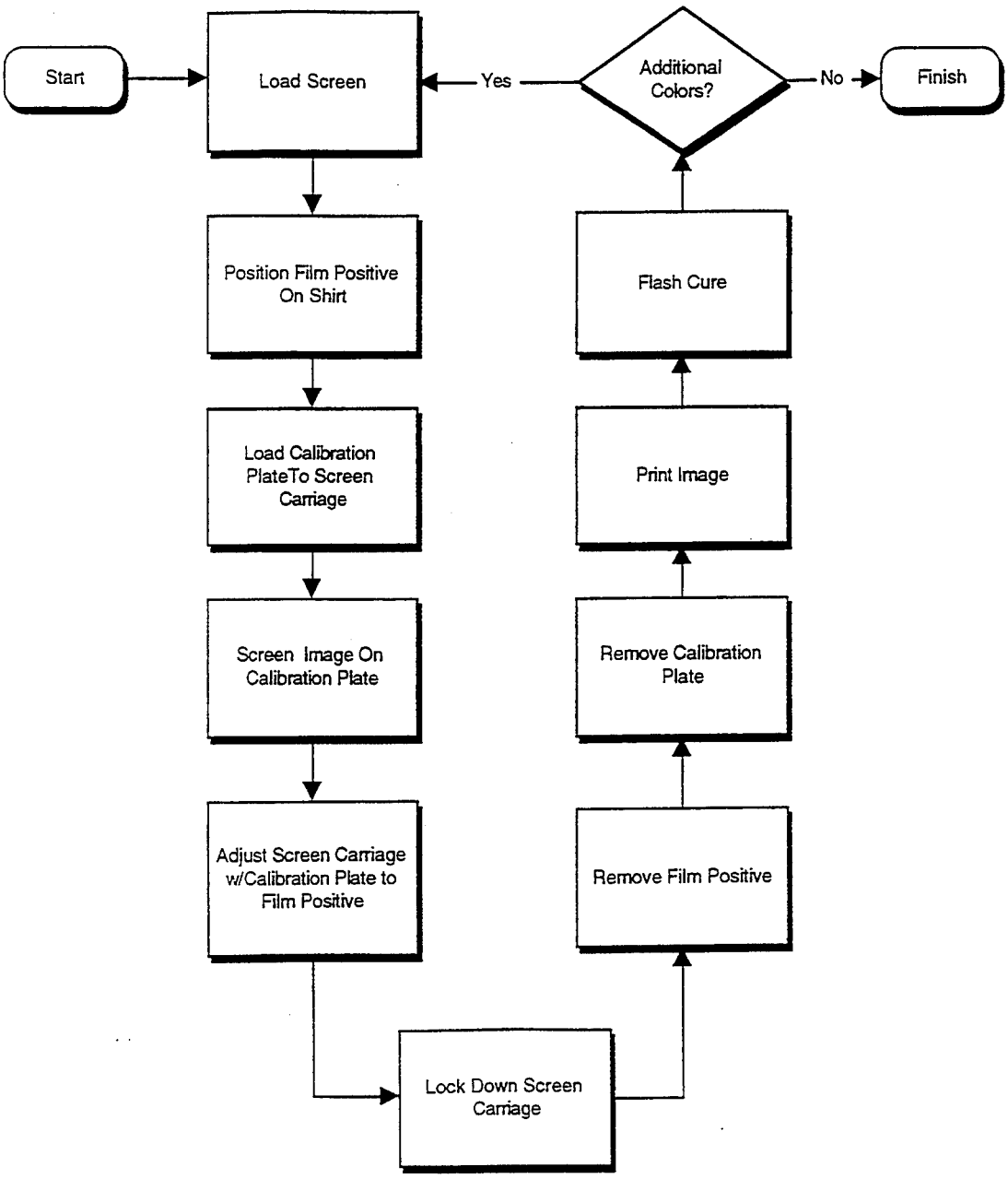
FIG. 14 is a flow chart showing the simplified sequence of steps required for screen printing multi-colored images, using the apparatus of the present invention.

After a color screen holder has been brought into proper registration with a platen bearing a substrate in the sequence of steps shown in rows 1 and 2 of FIG. 13, these steps must be reiterated for each successive color image to be printed, as shown in row 3. After all screen holders have been properly aligned with a platen, utilizing multiple trial and error procedures for each color image, the target on each screen must be blocked over with blackout tape prior to production of a quantity of printed articles. This step is shown in row 4 of FIG. 13. Thus, it can be appreciated that alignment of screen holders prior to beginning a production run of objects printed with multi-colored images is a time consuming and tedious process using prior art screen printing methods and apparatus. By way of contrast, the novel doubly articulated screen printing apparatus with on-line registration capability, according to the present invention and described above, eliminates many of the steps required for multi-color screen printing and summarized in FIGS. 12 and 13. FIG. 14 summarizes the greatly simplified process flow for multi-color screen printing using the apparatus of the present invention, which process flow will now be described.

As shown in FIGS. 1 and 2, doubly articulated screen printing apparatus 20 according to the present invention includes four rotatable platens 35 and six rotatable screen printing mechanisms 21. It is to be understood that apparatus 20 could be constructed with fewer or more platens, and fewer or more screen printing mechanisms 21, without departing from the spirit of the present invention. Also, FIGS. 1 and 2 show two of the six screen printing mechanisms 21 removed, for clarity of description.

Referring now to the flow chart of FIG. 14 in conjunction with additional figures indicated below, the first step in utilizing the screen printing apparatus 20 according to the present invention consists of installing a silk screen A bearing a first color image in screen clamp 25, tightening thumbscrews 90 against a side member B of the screen frame, as shown in |FIGS. 10 and 11. Then, a first film positive is placed on top of a T-shirt or other substrate to be printed, which substrate has been first placed on a platen 35, such as the right-hand platen in FIG. 1. Next, as shown in FIG. 6, a thin, transparent, rectangularly-shaped plastic calibration plate 110 provided through its thickness dimension with a pair of holes 111 aligned with registration pins 104 of alignment bar 102, the holes being located near the rear edge of the calibration plate, is placed over the film positive and substrate, the holes receiving the registration pins to locate the calibration plate in a precisely repeatable location relative to the film positive, substrate, and platen 35. This step is performed with screen clamp 25 and screen A pivoted to an upward position on second articulation axis, or wrist joint 26, as shown in FIG. 6. It should be noted that during the entire calibration procedure to be described, printing head support arm 22 is maintained in a fixed position relative to platen 35 because locating plate 105 protruding downwards from rear forearm 38 of the printing head support arm is engaged within groove 108 of V-block 106, as may be understood by referring to FIGS. 1 and 7.

After a calibration plate 110 has been installed over a substrate as described above, screen clamp 25 and silk screen A are then pivoted downwards on wrist joint 26 into contact with the calibration plate, as shown in FIG. 11. The first color ink is then poured onto the upper surface of the screen, and a squeegee drawn across the screen to force ink through the screen to print an image, in the conventional screen printing manner, on the upper surface of calibration plate 110. Screen clamp 25 and silk screen A are then pivoted upwards as shown in FIG. 11. With silk screen A pivoted upwards away from calibration plate 110, printer head 23, including screen clamp 25, alignment bar 102, and the attached calibration plate, may then be moved in any direction in a horizontal plane relative to printing head support arm 21, after clamping plate 62 is loosened. This step is accomplished by rotating handlegrip 77 in a counter-clockwise direction. Handlegrip 77 and handlegrip 81 may then be grasped by opposite hands, and screen printing head moved in any direction in a horizontal plane required to precisely align the image printed on calibration plate 110 with the film positive, a reference point or a substrate underlying the calibration plate, or with an image previously printed on the substrate. After precise alignment has been achieved, handlegrip 77 is rotated clockwise to tighten clamping plate 62, securing printing head 23 at that position, relative to printing mechanism support arm 21, that brings screen A into precise alignment with the substrate on platen 35.

The calibration plate and film positive are then removed from platen 35, whereupon screen frame A may then be pivoted downwards into a precisely aligned printing position over a substrate or platen 35. A precisely aligned image may then be printed on the substrate, screen clamp 25 and screen A pivoted upwards once again, and the substrate subjected to heat to dry the inked image, in a step referred to as flash curing. Other platens bearing substrates may then be rotated into place beneath a printing mechanism 21 calibrated as described above, and precisely registered images printed on as many substrates as desired. Different color images, such as identified by the numerals 2 and 3 on substrates in FIGS. 1, 2, 4 and 6 may be brought into precise alignment with image 1, by calibrating the screen printing mechanism 21 holding the screens for those images, in a manner exactly analogous to that described for calibrating the printer mechanism bearing the first image screen. It should be noted that the on-line registration capability of the novel apparatus and method according to the present invention eliminates the requirement for trial and error printing on test stock, while providing a capability for producing any number of precisely aligned, multi-color images on any desired quantity of substrates, in a highly efficient manner.

What is claimed is:

1. A screen printing mechanism comprising;

a. screen frame clamping means adapted to clampingly hold an elongated screen frame member, b. a base section pivotably supporting said screen frame clamping means in a manner permitting pivotability in a vertical plane of said screen clamping means from a horizontal printing position to an upright position, c. a transparent calibration plate, d. an alignment bar attached to said base section, said alignment bar including registration means for removably securing said calibration plate in a precisely repeatable location relative to said base section, e. an object platen.

f. base section support means comprising in combination a horizontally disposed yoke plate having through its thickness dimension an aperture, and a downwardly depending member protruding from said base section of smaller diameter than said aperture and protruding therethrough, whereby said downwardly depending member may be moved within said aperture to move said base section to a desired horizontal position with respect to said object platen, and g. base section clamping means for releasably securing said base section to said support means at said horizontal position.

2. The mechanism of claim 1 wherein said registration means of said alignment bar is further defined as comprising in combination at least one registration member protruding from said alignment bar, and a complementarily shaped aperture in said calibration plate.

3. The mechanism of claim 1 wherein said registration means of said alignment bar is further defined as comprising at least two registration pins protruding from said alignment bar.

4. The mechanism of claim 3 wherein said calibration plate is further defined as having through its thickness dimension at least two perforations adapted to align with and insertably receive said registration pins of said alignment bar.

5. The mechanism of claim 1 wherein said clamping means is further defined as comprising in combination a clamping plate of larger diameter than said aperture in said yoke plate, said clamping plate being located below said yoke plate, and means for releasably securing said clamping plate to said downwardly depending member protruding downwards from said base section.

6. The screen printing mechanism of claim 1 wherein said downwardly depending member from said base section is further defined as having an externally threaded shank.

7. The screen printing mechanism of claim 6 wherein said clamping means is further defined as comprising in combination a clamping plate of larger diameter than said aperture in said yoke plate, said clamping plate being located beneath said yoke plate and having a threaded bore for threadingly receiving said externally threaded shank of said downwardly depending threaded member, whereby said shank may be tightened into said threaded bore so as to draw said clamping plate towards said base section, thereby compressively clamping said yoke plate between said base section and said clamping plate.

8. The screen printing mechanism of claim 7 further including transversely disposed means for tightening and loosening said downwardly depending threaded member in said threaded bore of said clamping plate.

9. The screen printing mechanism of claim 8 wherein said transversely disposed means for tightening and loosening said downwardly depending threaded member in said threaded bore of said clamping plate comprises in combination a longitudinally disposed cam pin attached eccentrically to said downwardly depending threaded member, a transversely disposed cam block having a longitudinally disposed notch rotatably receiving said cam pin, a lead screw threadingly engaging a threaded bore in said cam block, and a handlegrip attached to said lead screw, whereby said cam block can be advanced and retreated by rotating said handlegrip, thereby causing said cam block and cam pin to exert a loosening or tightening torque on said downwardly depending threaded member within said threaded bore of said clamping plate.

10. A screen printing apparatus comprising at least one screen printing mechanism attached to an outer longitudinal end portion of an elongated, radially disposed screen support arm, said arm being attached at an inner longitudinal end portion thereof to a first rotatable hub, said screen printing mechanism including;

a. screen frame clamping means adapted to clampingly hold an elongated screen frame member, b. a base section pivotably supporting said screen frame clamping means at a wrist joint in a manner permitting pivotability in a vertical plane of said screen frame clamping means from a horizontal printing position to an upright position, c. an elongated horizontally disposed alignment bar attached to said base section, said alignment bar having protruding from its upper surface a pair of registration pins, d. a thin, flat, transparent calibration plate having through its thickness dimension a pair of perforations adapted to insertably receive said registration pins of said alignment bar, e. base section support means including means for positioning said base section at a desired horizontal position in a horizontal plane, relative to said screen support arm, and f. base section clamping means for releasably securing said base section to said support means at said desired horizontal position.

11. The apparatus of claim 10 wherein said screen support arm is further described as including an elbow joint located radially inwards of said wrist joint, said elbow joint being adapted to permit pivotability in a vertical plane of said printing mechanism.

12. The apparatus of claim 11 further including at least one platen adapted to hold an object to be printed at a location underlying a screen clampingly held in said screen frame clamping means.

13. The apparatus of claim 12 wherein said platen is further defined as being attached to a radially disposed platen support arm located beneath said screen support arm.

14. The apparatus of claim 13 further comprising means for permitting rotation of said platen support arm with respect to said screen printing machine.

15. The apparatus of claim 13 further comprising a second hub, said platen support arm being attached at the inner end thereof to said second hub and rotatable independently of said first hub.

16. The apparatus of claim 10 wherein said means for positioning said base section at a desired horizontal position relative to said screen support arm is further defined as comprising in combination a horizontally disposed yoke plate having through it thickness dimension an aperture, and a downwardly depending member protruding from said base section of smaller diameter than said aperture and protruding therethrough, whereby said downwardly depending member may be moved within said aperture, thereby moving said base section to a desired horizontal position.

* * * * *